United States Patent [19]

Johnson et al.

[11] Patent Number: 4,804,420

[45] Date of Patent: Feb. 14, 1989

[54] METHOD FOR DEGREASING A CONTINUOUS SHEET OF THIN MATERIAL

[75] Inventors: Peter E. Johnson; James Young, both of Corvallis, Oreg.

[73] Assignee: Entek Manufacturing, Inc., Lebanon, Oreg.

[21] Appl. No.: 24,359

[22] Filed: Mar. 10, 1987

Related U.S. Application Data

[62] Division of Ser. No. 700,525, Feb. 11, 1985, Pat. No. 4,648,417.

[51] Int. Cl.[4] ..... B08B 7/02

[52] U.S. Cl. ..... 134/15; 134/31; 134/64 R; 134/95; 134/105; 34/80

[58] Field of Search ..... 134/10, 11, 12, 15, 134/31, 64 R, 64 P, 95, 105, 107, 109, 108, 122 R, 122 P, 18 C; 34/80

[56] References Cited

U.S. PATENT DOCUMENTS

| | | | |
|---|---|---|---|
| 3,351,495 | 11/1967 | Larsen | 210/500.36 |
| 3,815,615 | 6/1974 | Holm | 134/11 |
| 4,078,942 | 3/1978 | Luisi et al. | 134/10 |
| 4,138,273 | 2/1973 | Lukac et al. | 134/10 |
| 4,648,417 | 3/1987 | Johnson et al. | 134/105 |

*Primary Examiner*—W. J. Shine

*Assistant Examiner*—Sharon T. Cohen

*Attorney, Agent, or Firm*—Chernoff, Vilhauer, McClung & Stenzel

[57] ABSTRACT

A method for removing processing oil from thin sheets of microporous plastic material is comprised of a tank having a liquid zone in its bottom portion which is divided into three sub-tanks having decreasing depths extending across the tank. Heating coils in each sub-tank vaporize the solvent to form a cleaning zone, containing vaporized solvent, above the liquid portion, and condensing coils located at the top of the tank condense the vaporized solvent and deposit it into the deepest sub-tank which also is supplied fresh make up solvent when required. A series of rollers feeds the material through the tank, from the side having the shallowest sub-tank toward the side having the deepest sub-tank, while repeatedly passing it between the cleaning zone where solvent is condensed on it to clean it, and the condensing zone where it is cooled to a temperature below the temperature of the vaporous solvent. Precondensing coils located medially in the tank between each pass of the material as it extends between the condensing zone and the cleaning zone and vice versa, define the extent of the cleaning zone and direct condensed solvent onto the material to wash said material.

5 Claims, 4 Drawing Sheets

METHOD FOR DEGREASING A CONTINUOUS SHEET OF THIN MATERIAL

This application is a division of application Ser. No. 700,525, filed 2/11/85.

BACKGROUND OF THE INVENTION

This invention relates to a method and apparatus for degreasing thin sheets of material and in particular to the removal of processing oil from the pores of sheets of microporous plastic material.

Material of this type has many uses, a typical one being the envelopes which contain the plates in lead acid storage batteries. The composition of such material is described in detail in Wayne, U.S. Pat. No. 3,351,495. The material is made from a mixture of plastic, usually a high molecular weight polyolefin, a filler, such as silica, talc, calcium carbide or carbon black, and a plasticizer, typically a petroleum-based oil. The mixture has a high percentage of plasticizer, typically 70 percent by weight, which is dispersed throughout the material in microscopic veins. After mixing, the heated mixture is extruded and calendered to produce a thin sheet which is cooled to room temperature in order to harden it. Lastly a substantial portion of the plasticizer is extracted from the sheet leaving pores which give the finished material its desirable characteristics.

Since approximately 50 percent of the total weight of the sheet is removed as oil, and the oil is distributed throughout the material in a network of extremely small diameter pores, the removal of the oil is not a simple matter. Heretofore oil has been extracted from this type of material by immersing in a liquid solvent. As the oil is removed from the material the solvent becomes soiled and, as a result, less effective. Therefore, the prior art devices used multiple tanks with solvent flowing from one tank to the next in the opposite direction that the material moves through the tanks so that the first tank the material passes through has the highest percentage of oil in it and each succeeding tank has a lower concentration of oil. However, since liquid extraction is a slow process large tanks are required and large quantities of solvent must be used. This not only makes the cost of the extraction system very high but also requires a large floor area for the tanks. In addition, large tanks have large surface areas thereby causing large quantities of the solvent to evaporate. Finally, the large volumes of the solvent which are used means that the energy cost for recovery of the oil from the solvent is high since the solvent must be evaporated to achieve separation.

For the foregoing reasons, the prior art degreasing systems are extremely expensive to build and to operate, are very inefficient of material and energy, and cause high levels of pollution. What is needed therefore is a way to remove the processing oil from thin microporous material which overcomes the shortcomings and limitations of the prior art systems.

SUMMARY OF THE INVENTION

The degreasing apparatus of the present invention comprises an open top tank which has liquid solvent located in a liquid zone in its lower portion. Three upstanding baffles divide the liquid zone into four sub-tanks of descending depth, and a solvent inlet enters into the deepest sub-tank and a solvent outlet exits from the shallowest sub-tank. A heating coil located in each sub-tank heats the solvent in that sub-tank. A material inlet slot is located in the top of the tank sidewall at the end of the tank having the shallowest sub-tank and a material outlet slot is located across from the material inlet in the opposite side of the wall.

Nine equally spaced upper rollers extend across the top of the tank parallel with the inlet and outlet slots. The upper rollers are mounted on axles which are journaled rotatably in bearing blocks located on the tank sidewalls. The upper rollers fit loosely on the axles such that they are rotatable with respect to one another but with some frictional drag therebetween. Drive gears are attached to the ends of the axles outside of the tank. Idler gears are freely, rotatably mounted on the outside of the tank below, and co-axial with the drive gears with one idler gear being located between each adjacent pair of upper rollers and one being located outwardly of the upper roller which is located adjacent to the material inlet slot. A motor located on the side of the tank defining the material outlet slot drives a sprocket which is co-planar with the drive gears and idler gears, and a drive chain interconnects the sprocket, the drive gears, and the idler gears in a serpentine pattern.

The top of the tank is enclosed by a lid which can be raised and lowered by means of a motor. Eight C-shaped brackets, which are attached to the lid, have legs which extend downwardly into the tank. Extending between each set of legs is a lower roller which is similar to the upper roller except that it is mounted to rotate freely. One of the lower rollers is located between each adjacent set of upper rollers. Thus a thin sheet of material which is wrapped over the upper rollers and under the lower rollers extends across the tank in a serpentine pattern.

The solvent which is vaporized by the heating coil in the bottom of the tank is condensed at the top of the tank by a condensing coil which is fed with chilled water, thereby forming a cleaning zone between the condensing zone and the liquid zone which contains vaporized solvent. The solvent condensed by the condensing coil is fed through the solvent inlet into the liquid zone of the tank where it is recycled. In order to better define the extent of the cleaning zone, precondensing coils are placed in the tank below each of the upper rollers. Deflectors located on the precondensing coils collect the solvent condensed by them and directed it onto the material as it is moving upwardly through the tank.

A chilling coil located at the extreme top of the tank ensures that all of the solvent is condensed before it reaches the top of the tank. A water seal is incorporated with the lid which encloses the tank to prevent any solvent vapor which should happen to pass the chilling coil from leaving the system.

An enclosure located adjacent to the material outlet slot in the tank contains a series of spaced apart pipes containing orifices which face toward the material. Steam which is discharged through the pipes impinges upon the degreased material and displaces the solvent vapor located in its pores with steam. An air dryer is then used to remove the steam from the material.

Included with the degreaser are valves and instrumentation to control the amount of heating by the heating coils and cooling by the condensing and precondensing coils along with piping to provide steam and chilled water respectively to these systems.

Also included with the degreaser are evaporative separators which separate the oil from the solvent for reuse in making additional material. The vaporized solvent from the separators is directed back into the tank where it is used to clean the material. Therefore the system is self-contained and little make up solvent is required since little solvent is lost from the system. Furthermore, since the solvent from the separator is reintroduced into the tank as vapor, a large portion of the energy required for separation is not lost but serves to lower the energy requirement for heating the solvent in the first instance.

Condensers and separators are also provided to condense and separate the solvent which has been removed from the material from the steam which was used to remove it. This solvent also is placed back into the tank. Therefore almost all of the solvent is recovered and reused.

Accordingly, it is a principal objective of the present invention to provide a degreasing apparatus and a method for its use which is effective in removing processing oil from thin sheets of microporous material.

It is a further object of the present invention to provide such a method and apparatus which uses vaporized solvent to remove the oil.

It is a further object of the present invention to provide such a method and apparatus wherein the material is repeatedly cooled below the temperature of the vaporized solvent and then is rewarmed by the condensing solvent.

It is a still further object of the present invention to provide such a method and apparatus where the solvent used for degreasing is recovered continuously during operation of the apparatus.

It is a still further object of the present invention to provide such a method and apparatus in which solvent recovery occurs in a closed self-contained system.

It is yet a further object of the present invention to provide such a method and apparatus where the energy used to separate the solvent and oil is utilized to maintain the solvent in a vapor state for cleaning.

It is a further object of the present invention to provide such a method and apparatus wherein a portion of the vaporized solvent is condensed and used to physically wash the material while it is being degreased by the vaporous solvent.

It is a still further object of the present invention to provide such a method and apparatus wherein very little of the solvent is lost from the system.

It is a further object of the present invention to provide such a method and apparatus which minimizes the amount of solvent being utilized in the system at any time.

It is a further object of the present invention to provide such a method and apparatus which is energy efficient.

It is a yet further object of the present invention to provide such an apparatus which is compact and does not consume much space.

The foregoing and other objectives, features and advantages of the invention will be more readily understood upon consideration of the following detailed description of the invention taken in conjunction with the accompanying drawings.

DETAILED DESCRIPTION OF THE INVENTION

Figure 1:
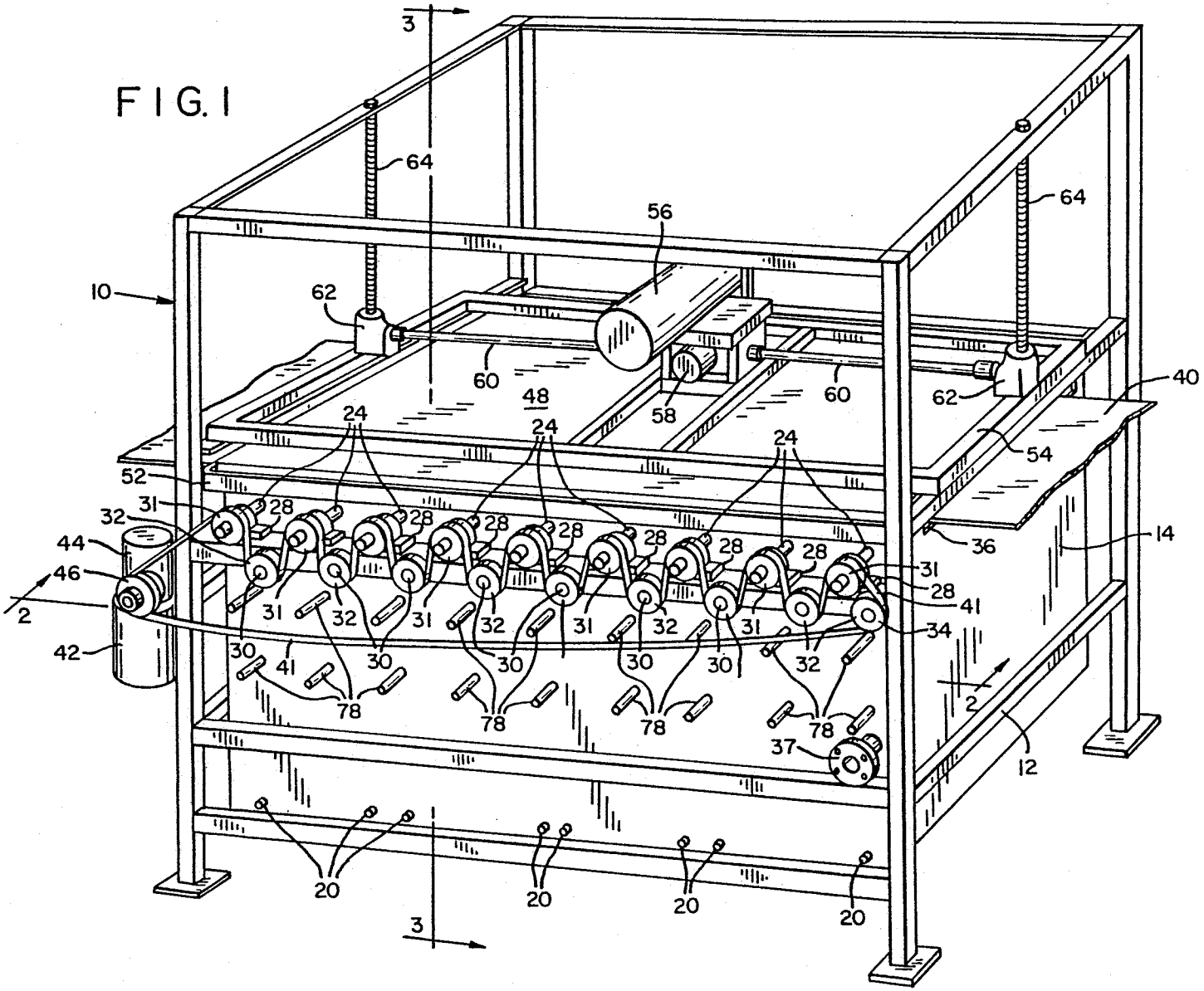
FIG. 1 is a perspective view of a degreasing apparatus embodying the features of the present invention.
Figure 2:
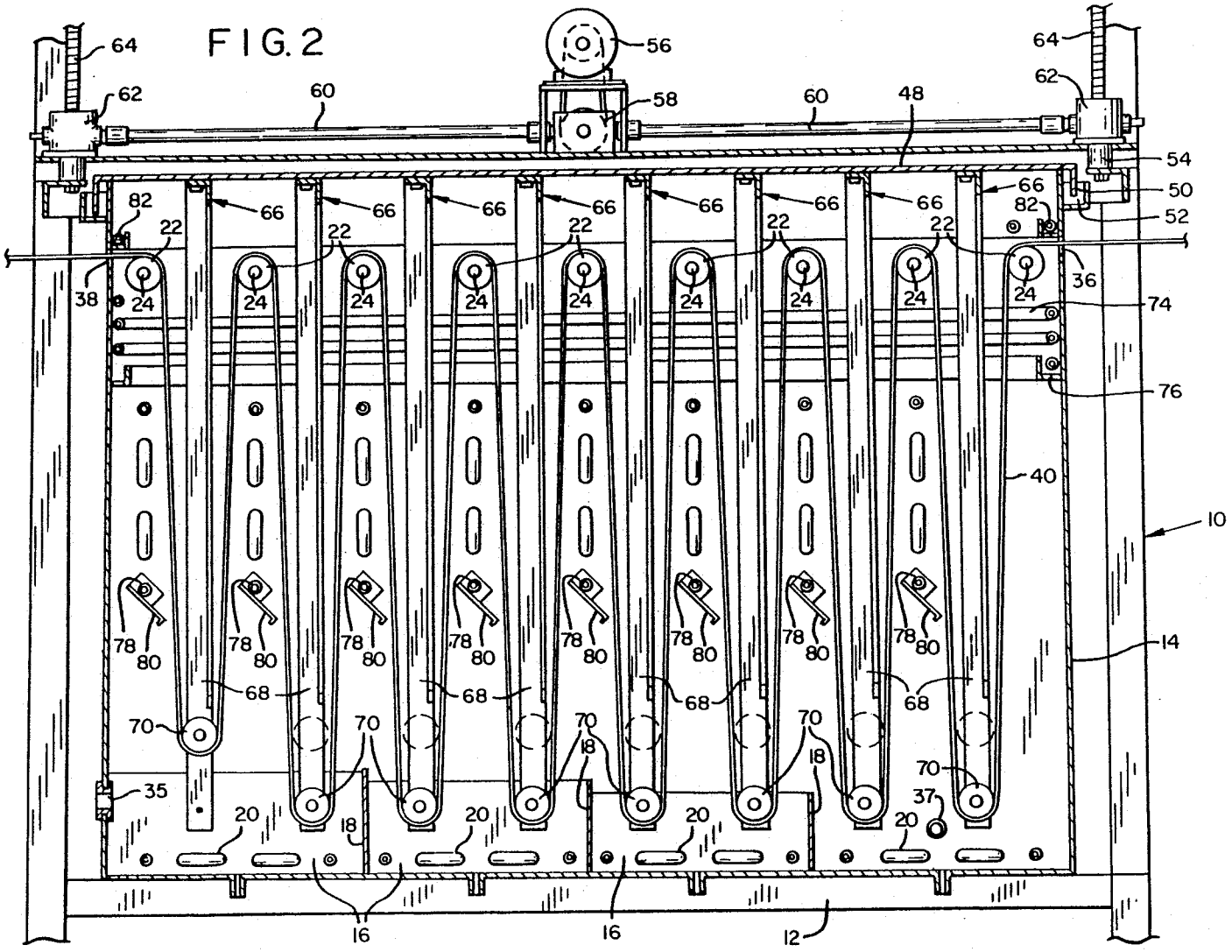
FIG. 2 is a sectional view taken along the line 2—2 in FIG. 1.
Figure 3:
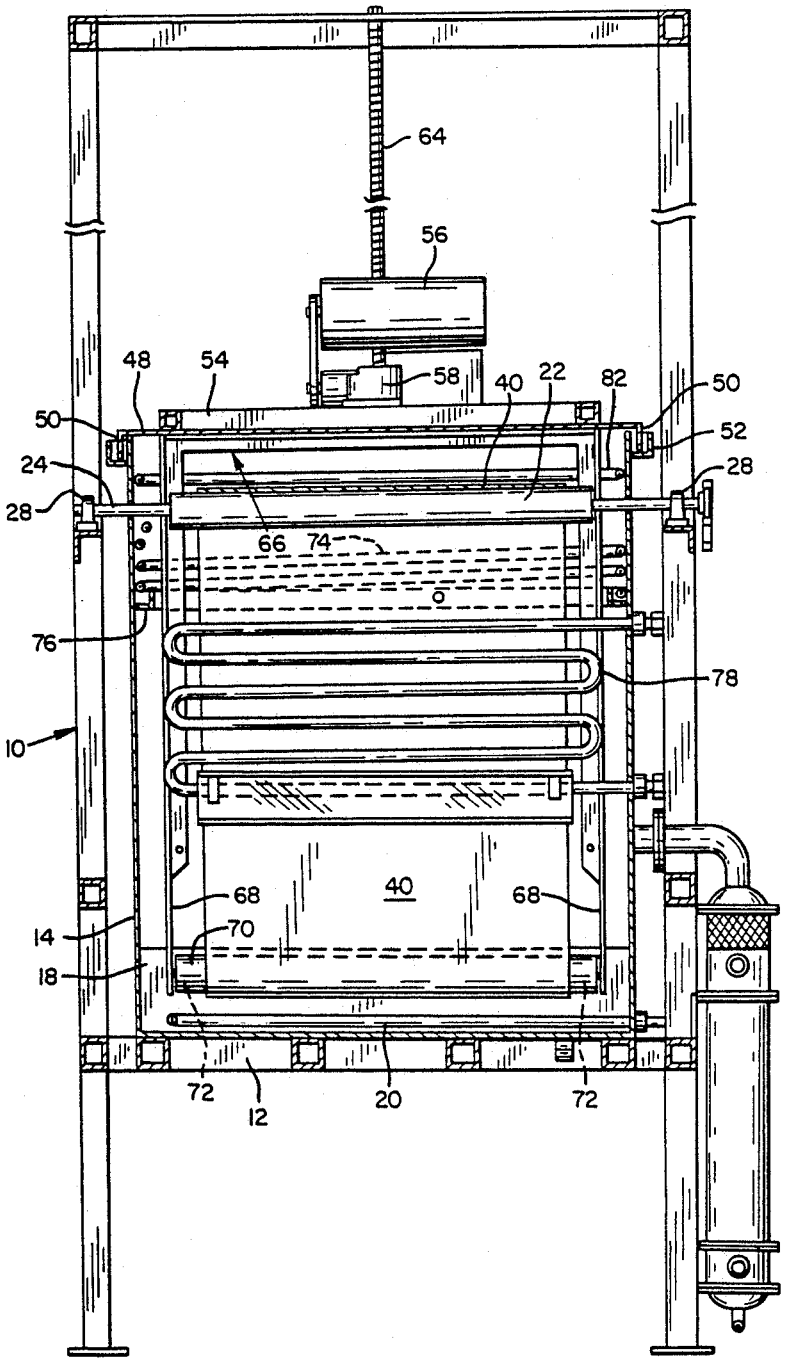
FIG. 3 is a sectional view taken along the line 3—3 in FIG. 1.

Referring to FIGS. 1–3 of the drawings, the degreasing apparatus of the present invention includes an upright stand 10 which supports the remaining elements. Resting on a shelf 12 spanning the lower portion of the stand 10 is a rectangular open-topped degreasing tank 14. The lower portion of the tank, which forms a liquid zone that carries liquid solvent, is divided into four sub-tanks 16 by means of three upstanding baffles 18 which are arranged in order of descending height extending across the tank. The solvent, which fills all of the sub-tanks to the tops of their respective baffles, preferably is a high molecular weight solvent having a low boiling point, such as a chlorinated hydrocarbon. Located near the bottom of each sub-tank is a serpentine tubular heating coil 20 which has an inlet and outlet that pass through the walls of the tank. A solvent inlet 35 opens into the deepest sub-tank and a solvent outlet 37 opens into the shallowest sub-tank at a level below the top of the lowest baffle 18. Thus, the baffles define the level of the three deepest sub-tanks and the solvent outlet defines the level of the shallowest sub-tank. Located in opposed side walls of the tank, near its top edge, are inlet 36 and outlet 38 slots which are dimensioned to receive the sheet of material 40 which is degreased in the apparatus.

Extending across the tank are nine equally spaced upper rollers 22 whose top surfaces are parallel and co-planar with the inlet and outlet slots 36, 38. The rollers are carried rotatably by cylindrical axles 24 through bushings (not shown) which are located at each of the ends of the rollers. The bushings are fixed in the upper rollers and extend light friction against the axles 24. The axles, in turn, are journaled in bearing blocks 28 located on the sides of the tank, and one end of each axle extends outside of the tank and has a drive gear 31 fixedly attached to its extremity. Thus, when the axles are rotated the upper rollers 22 will rotate with them if unimpeded, although possibly at a lower speed. However, if impeded, the rollers will not be forced to rotate with the axles. Rotatably journaled on stubs 30 located on the wall of the tank are eight idler gears 32 with one of the idler gears being located between and slightly below every adjacent set of drive gears. A ninth idler gear 34, located co-planar with the other idler gears but outwardly of the roller 22 which is closest to the inlet slot 36, is mounted adjustably relative to the other idler gears to take up slack in the chain 41 which drives the upper rollers. Located on the side of the tank with the outlet slot 38 is a motor 42 and gear reduction unit 44 which drive the chain 40 through a drive sprocket 46. The chain 40 passes over the drive gears 31 and under the idler gears 32 in order to create a positive slip-free drive train.

The top of the tank 14 is covered by a lid 48 which has a downwardly extending lip 50 around its periphery which protrudes into a water-filled trough 52 that extends around the outside of the tank. Thus the water acts as a vapor barrier against leakage of solvent vapor from the tank. Attached to the top of the lid is a lift frame 54 which has a motor 56 and gear box 58 mounted medially on it. The gear box is connected through shafts 60 which extend to the sides of the lift frame, to drive units 62 having mating threaded rods 64 which are attached to the stand 10. Thus when the motor is operated in one direction the drive units move up the threaded rods to raise the lid and when it is operated in the other direction they move down the threaded rods to lower the lid.

Extending downwardly from the lid are eight C-shaped brackets 66, one being located between each adjacent set of upper rollers. Extending between the legs 68 of each of the brackets 66 is a lower roller 70 which is similar to the upper rollers 22, however, the lower rollers are journaled on stubs which depend from the legs 68 and thus are freely rotatable. In the embodiment illustrated, all of the lower rollers, except the one closest to the outlet slot 38, are located in the liquid zone. However, in an alternate embodiment, shown in dashed lines in FIG. 2, all the rollers are located above the liquid zone. In this case the baffles 18 are not required and the heating coils can be continuous with a single control valve. Even in this embodiment it may be desirable to have the material dip into the liquid zone on its final pass in order to control the concentration of oil in the material, and, in that case, at least one baffle would be required. In either event the stand 10 and threaded rods 64 are arranged such that when the lid is raised the lower rollers 76 are completely above the upper rollers 22 to allow the material to be loaded into the device.

Located in the tank 14 immediately below the upper rollers 22, is a condensing coil 74 which spirals around the tank in several loops proximate its walls. A condensate trough 76 is attached to the inner walls of the tank immediately below the condensing coil to catch the solvent which is condensed by the condensing coil. This condensed solvent is directed through the solvent inlet 35 into the deepest sub-tank to be reused.

In addition to the condensing coil 74, located in the tank between the upper and lower rollers are eight precondensing coils 78, each of which makes six vertically aligned passes across the center of the tank, with one precondensing coil being located below each of the upper rollers. Mounted on the bottom run of each of the precondensing coils is a deflector 80 which catches the solvent condensed by that precondensing coil and washes it over the sheet of material 40 as it moves upwardly between the respective lower and upper rollers.

Finally, located at the top of the tank is a chilling coil 82 which makes a single loop around the inside walls of the tank to ensure that any vaporous solvent which rises past the precondensing and condensing coils will be condensed and not escape from the tank.

The degreaser of the present invention is used to remove oil from thin sheets of thermoplastic material which had processing oil dispersed through them when they were formed in order to create microscopic pores in the furnished material. Such material, which is well known in the prior art, is commonly used as separator material for encapsulating the plates in lead acid storage batteries. As will be more fully explained later, the system in which the degreaser is used is utilized in the manufacture of such material and allows the oil which is recovered from the finished material to be continuously recovered and reused in the manufacture of additional material.

Once the material is fed into the degreaser and the solvent is brought up to its boiling temperature, material is pulled through the device by an appropriate take-up apparatus (not shown). The motor 42 and chain drive system which rotate the upper rollers 22 do not, in and of themselves, move the material through the tank 14 but merely act as an accummulator to prevent the rollers from causing a drag on the material and to prevent any slack from occurring.

As the material first enters the tank at room temperature said material is exposed to the warm solvent vapor which condenses on said material as pure liquid solvent and dissolves some of the oil. However, due to the thinness of the material, it soon becomes heated to the vapor temperature and no further solvent will be condensed on the material. At this point the material passes under the first rollers 71 and is directed upwardly into the cool condensing zone created by the precondensing coil 78 and the condensing coil 74 where it is cooled substantially below the temperature of the vaporous solvent. Thus, when it is passed over the next upper roller 22 and back downwardly into the cleaning zone, more solvent is condensed on it to dissolve more oil. In addition, each time the material changes direction by passing around an upper or lower roller it is compressed and oil is squeezed out of the pores where it is exposed for easier dissolving. In addition to this vapor cleaning, the solvent which is condensed by the precondensing coils is directed onto the material by the deflectors 80 as said material moves back up through the cleaning zone to provide liquid cleaning while the material is being cooled, as well as providing a mild scrubbing action which is not provided by the vapor cleaning.

The relative extent of the cleaning and condensing zones is controlled primarily by the amounts of cooling water which flows through the precondensing coils. While the condensing coils also effect the extent of the respective zones somewhat, it primarily serves to condense the solvent at the top of the degreaser and thus recycle it for further use. The chilling coil 82 provides further condensing to prevent solvent vapor from reaching the top of the tank.

Since fresh solvent enters the tank on the side opposite that which the material enters it, the solvent in the first or deepest sub-tank has the lowest percentage of oil mixed in it and the oil in the last or shallowest sub-tank has the greatest concentration of oil in it. Thus the soiled solvent is removed for cleaning through the solvent outlet 37 only after it is fully contaminated. Since each sub-tank has its own individually controlled heating coil, each sub-tank only needs to be heated to the boiling temperature for solvent having that particular degree of contamination. Also, in the event that the lower rollers are placed below the liquid solvent level to achieve washing, each time the material is cleaned in the cleaning zone, there is counterflow between the solvent and material so that the material is immersed into the most contaminated solvent when it has the highest level of oil in it and into the least contaminated solvent when it has the lowest level of oil in it.

Figure 4:
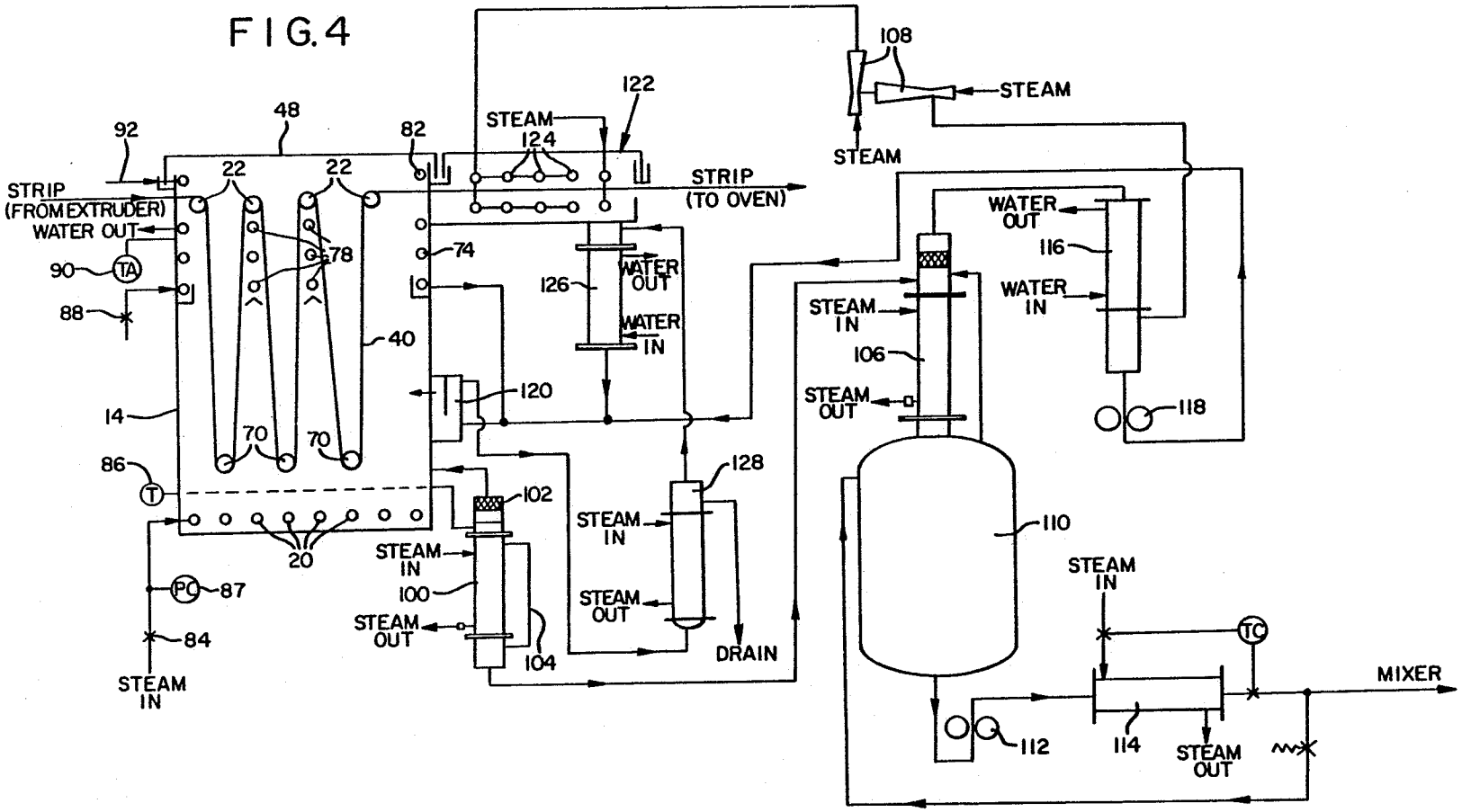
FIG. 4 is a flow chart showing the elements used with the method of the present invention.

Referring to FIG. 4, the system with which the degreasing tank of the present invention is utilized to remove processing oil from microporous material includes a source of steam or other heat transfer medium (not shown) and control valves 84 which control the amount of steam which flows through each of the heating coils 20. Temperature gauges 86 indicate the temperature of liquid solvent in each of the sub-tanks 16, and pressure gauges 87 indicate the pressure of the steam in each heating coil.

In addition, a source of cooling water or other suitable heat transfer fluid (not shown) is provided to the condensing coil 74 and precondensing coils 78. Individual control valves 88 permit the flow rate to each coil to be controlled and temperature gauges 90 indicate the water temperature in each coil. The chilling coil 82 is also fed with cooled water, however, this water preferably is considerably cooler than the water which is fed to the condensing and precondensing coils. A control valve 92 allows the flow to the chilling coil to be adjusted. The valves used for all of the heating and cooling systems in the tank could include pressure regulation devices or feed back devices if it is desired to automate the system.

A long tube vertical evaporator 100 separates the solvent and oil mixture leaving the tank through the solvent outlet 37 by boiling the solvent off of the mixture. This vaporized solvent then is reintroduced back into the tank so that a portion of the energy spent in separating the solvent and oil is not lost but instead is used to lessen the amount of energy required to boil liquid solvent with the heating coils 20. The evaporator 100 uses a commercially available heat exchanger and has a metal mesh demisting element 102 located at its vapor exit to remove any oil which becomes entrapped in the vaporized solvent. A vapor balancing tube 104 is located in parallel with the heat exchanger portion of the evaporator to prevent a slugging effect from occurring as the solvent is boiled. Since the oil still contains five to ten percent solvent after leaving the evaporator 100 it preferably is processed through a second long tube vertical evaporator 106 which is similar to the evaporator 100 except that, in the embodiment illustrated, it has a vacuum applied to its vapor outlet by means such as a steam operated vacuum jet 108. Heat for vaporizing the solvent in the evaporators 100 and 106 is provided by steam from the same source which is used for the heating coils 20 and the vacuum jet 108.

The oil from the evaporator 106 is stored in a tank 110 from which it is withdrawn as required for use in formulating the mixture which is used to make the material from which the subject system removes oil. Since the oil has already been heated by the evaporator it preferably is cycled by a pump 112 through a steam heater 114 to maintain its temperature until it is withdrawn and to further strip any remaining solvent from it.

The vaporized solvent which is discharged from the second evaporator 106 is condensed in a commercially available condensor 116 and is returned to the tank through the solvent inlet 35 by a pump 118. A commercially available gravity separator 120 removes any water which becomes mixed with the solvent in the condensor 116.

Located downstream of the tank 14 is a solvent extractor 122 for removing solvent from the material after it has been degreased. The solvent extractor comprises a chamber (not shown) containing a series of pipes 124 having a plurality of openings (not shown) located in them which face the sheet of material. Steam is ejected from the openings in the pipe onto the material and displaces the solvent in it. In the preferred embodiment the steam is under pressure to insure that it covers the material fully but this is not necessary. The steam/solvent mixture from the solvent extractor is condensed in a commercially available condensor 126 and the resulting water/solvent mixture is discharged into the gravity separator 120 and the separated solvent is returned to the tank 14 through the solvent inlet 35.

Since the water from the gravity separator may contain traces of solvent it is passed through a steam heated evaporator 128 where the remaining solvent and a portion of the water are evaporated. The water then is discarded and the evaporated water solvent mixture is run back through the condensor 116. The last step in the process is to remove the vaporous steam from the pores, which is done in a drying oven (not shown) in which 240 degree air is blown onto both sides of the sheet of material.

Thus, the system totally reuses the solvent which is used for the extraction process and does so in an energy efficient manner. Most of the solvent is being separated continuously from the extracted oil internally in the apparatus due to its being vaporized as the primary method of degreasing. With the remaining solvent, not only is its heat not lost, any additional energy used to separate it from the oil is also retained in the system since the recovered solvent is discharged immediately back into the tank 14 at its elevated temperature thereby eliminating the necessity of reheating it with the heating coils. Also since the solvent remains in a closed system and cleaning is primarily as a result of vapor, little solvent is lost to the environment which not only minimizes the cost of replacing solvent but also prevents pollution.

The terms and expressions which have been employed in the foregoing description are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method for degreasing a continuous sheet of thin material comprising:

(a) providing a degreasing tank having liquid solvent located in a liquid zone defined in the lower portion thereof;

(b) heating said solvent in said liquid zone to vaporize a portion thereof and provide a cleaning zone above said liquid zone which contains saturated vaporous solvent;

(c) condensing said solvent with a cooling device in a condensing zone defined in said tank above said cleaning zone; and (d) passing the sheet through said tank in a manner such that the sheet repeatedly passes first through said condensing zone and then through said cleaning zone.

2. The method of claim 1 including the step of passing the material into said liquid zone each time the material passes into said cleaning zone.

3. The method of claim 1 wherein the rate at which the sheet passes between said cleaning zone and said condensing zone is such that the sheet remains in the condensing zone until the sheet has cooled to a temperature which is significantly below the temperature of the solvent vapor, and the sheets remain in the cleaning zone until the sheets temperature approaches the temperature of the solvent vapor.

4. The method of claim 1 including the step of directing solvent condensed in said condensing zone onto the sheet when the sheet is in said cleaning zone.

5. The method of claim 1 including the step of recycling said solvent when said solvent becomes contaminated with soil removed from the material by removing said soil from said solvent.

* * * * *